US009041318B2

(12) United States Patent
Miyashita et al.

(10) Patent No.: US 9,041,318 B2
(45) Date of Patent: May 26, 2015

(54) CYCLOTRON

(71) Applicant: SUMITOMO HEAVY INDUSTRIES, LTD., Tokyo (JP)

(72) Inventors: Takuya Miyashita, Niihama (JP); Kazutomo Matsumura, Tokyo (JP)

(73) Assignee: SUMITOMO HEAVY INDUSTRIES, LTD., Tokyo (JP)

( * ) Notice: Subject to any disclaimer, the term of this patent is extended or adjusted under 35 U.S.C. 154(b) by 0 days.

(21) Appl. No.: 14/017,751

(22) Filed: Sep. 4, 2013

(65) Prior Publication Data

US 2014/0062343 A1 Mar. 6, 2014

(30) Foreign Application Priority Data

Sep. 4, 2012 (JP) ..... 2012-194282

(51) Int. Cl.
*H05H 13/00* (2006.01)
*H05H 7/00* (2006.01)
*H05H 7/08* (2006.01)

(52) U.S. Cl.
CPC ..... *H05H 13/005* (2013.01); *H05H 7/00* (2013.01); *H05H 2007/082* (2013.01)

(58) Field of Classification Search
CPC ..... H05H 13/005
USPC ..... 315/500–507
See application file for complete search history.

(56) References Cited

U.S. PATENT DOCUMENTS

| | | | | |
|---|---|---|---|---|
| 4,076,990 | A * | 2/1978 | Hendry et al. | 376/151 |
| 4,641,057 | A * | 2/1987 | Blosser et al. | 313/62 |
| 7,920,040 | B2 * | 4/2011 | Antaya et al. | 336/185 |
| 2008/0258653 | A1 * | 10/2008 | Nutt | 315/502 |
| 2013/0328475 | A1 * | 12/2013 | Hashimoto | 313/47 |
| 2014/0062343 | A1 * | 3/2014 | Miyashita et al. | 315/502 |
| 2014/0139096 | A1 * | 5/2014 | Mitsumoto | 313/62 |
| 2014/0152198 | A1 * | 6/2014 | Mitsumoto | 315/502 |

FOREIGN PATENT DOCUMENTS

| | | | |
|---|---|---|---|
| JP | S58-209899 | A | 12/1983 |
| JP | 2005-251468 | A | 9/2005 |
| JP | 2009-205971 | A | 9/2009 |

OTHER PUBLICATIONS

CERN Hadron Ion Source Web publication 2009.*
Edward Forringer Doctoral Thesis 2004.*
David Clark "Ion Sources for Cyclotrons" Proceedings of 9th ICC conference 1981.*
J. Bol et al, "High Intensity H-Cyclotrons for Radioisotope Production", 1989 IEEE Particle Accelerator Conference Proceedings, 1989, p. 764-p. 766, XP002717834.

(Continued)

*Primary Examiner* — Douglas W Owens
*Assistant Examiner* — Srinivas Sathiraju
(74) *Attorney, Agent, or Firm* — Squire Patton Boggs (US) LLP

(57) ABSTRACT

A cyclotron that accelerates an ion using a magnetic field includes a hollow yoke and an ion source that is provided in the yoke and generates an ion. The ion source includes a conductive cylindrical body and a filament disposed in the cylindrical body. A current is supplied from a power supply to the filament, and a direction of the current supplied to the filament is changed.

1 Claim, 7 Drawing Sheets

(56) References Cited

OTHER PUBLICATIONS

A. K. Mitra et al, "Filament Power Supply Improvement of the TRIUMF RF System", 1993 IEEE Particle Accelerator Conference Proceeddings, 1993, p. 1303-p. 1305, XP002717835.

D. J. Clark, "Ion Sources for Cyclotrons", Proceedings of 9th International Conference on Cyclotrons and Their Applications, 1981, p. 231-p. 240, XP002717836.

European Search Report application No. 13020087.6 dated Jan. 14, 2014.

* cited by examiner

CYCLOTRON

INCORPORATION BY REFERENCE

Priority is claimed to Japanese Patent Application No. 2012-194282, filed Sep. 4, 2012, the entire content of each of which is incorporated herein by reference.

BACKGROUND

1. Technical Field

The present invention relates to a cyclotron having an internal ion source.

2. Description of the Related Art

As a technical document regarding a cyclotron, for example, the related art is known. The related art discloses a cyclotron that includes an ion source having a filament and accelerates ions generated by the ion source using a magnetic field.

Incidentally, as the ion source of the cyclotron, there are an internal ion source disposed inside a hollow yoke and an external ion source disposed outside a yoke.

SUMMARY

According to an embodiment of the present invention, a cyclotron that accelerates an ion using a magnetic field includes: a hollow yoke; and an ion source that is provided in the yoke and generates an ion. The ion source includes a conductive cylindrical body and a filament disposed in the cylindrical body. A current is supplied from a power supply to the filament, and a direction of the current supplied to the filament is changed.

DETAILED DESCRIPTION

Figure 1:
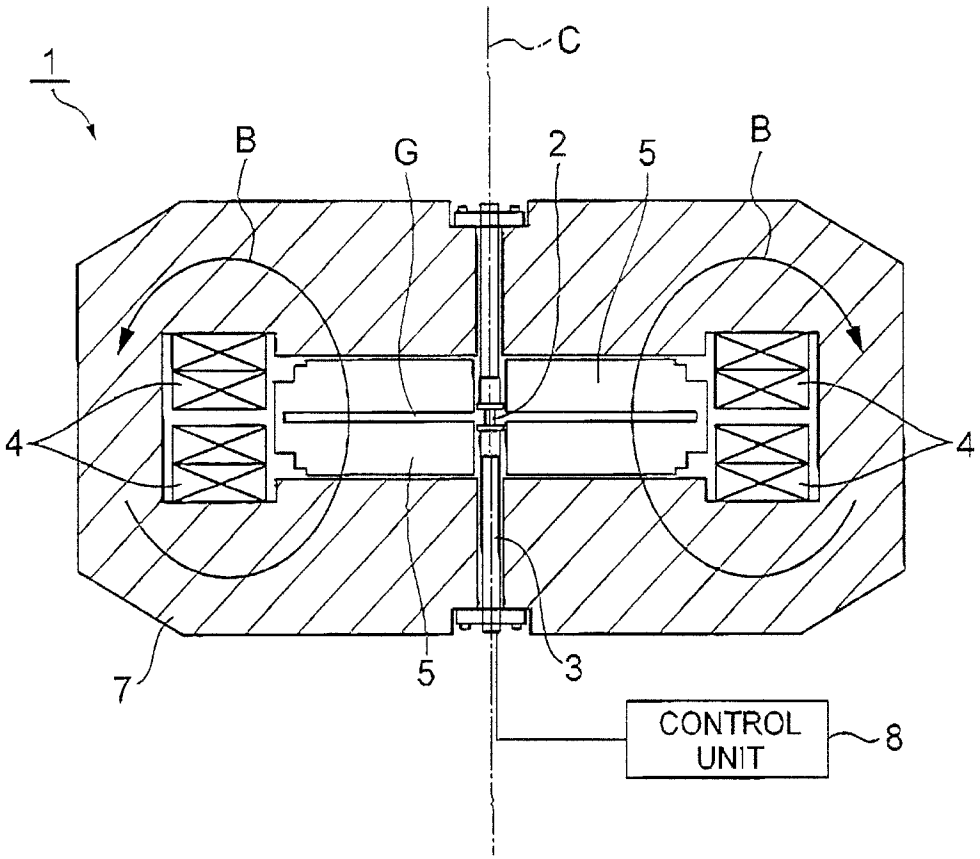
FIG. 1 is a cross-sectional view showing a cyclotron according to an embodiment of the present invention.

In the case of the internal ion source of these ion sources, there has been a problem in that performance degradation of a filament is fast due to the influence of a strong magnetic field generated by the cyclotron and accordingly frequent filament replacement is required.

Therefore, it is desirable to provide a cyclotron having an internal ion source capable of increasing the lifespan of a filament.

As a result of studies about the performance degradation of the filament, the inventors have found out that deformation occurring in the filament is the cause of the performance degradation. That is, when a current flows through the filament, a strong Lorentz force acts on the filament due to the influence of a strong magnetic field of 1 T [tesla] to 3 T [tesla] generated by the cyclotron. Although the filament is usually designed to have a certain degree of strength, the strength of the filament in use decreases gradually since the filament is in a high temperature state and the filament is thinning due to sputtering by electron. As a result, it has been found out that the deformation of the filament occurs without maintaining the strength against the Lorentz force.

In the cyclotron according to the embodiment of the present invention, even if the Lorentz force is applied to the filament due to the influence of a strong magnetic field, the direction of the Lorentz force is changed by changing the direction of the current supplied to the filament. Accordingly, compared with a case where the Lorentz force is continuously applied in a fixed direction, it is possible to suppress the deformation of the filament and increase the lifespan of the filament. As a result, since it is possible to reduce the frequency of replacement of the filament, it is possible to significantly reduce the maintenance cost and maintenance effort for the cyclotron.

The cyclotron according to the embodiment of the present invention may further include a control unit that changes a direction of the current, and the current may be a DC current.

According to this cyclotron, the direction of the DC current is changed by the control unit. Therefore, compared with a case where the direction of the current is constantly changed using an AC current, it is possible to perform effective current control considering the state of the filament.

In the cyclotron according to the embodiment of the present invention, a current may flow in a direction perpendicular to a magnetic field at a distal end of the filament.

According to this cyclotron, a so-called hot cathode PIG ion source, in which a current flows in a direction perpendicular to the magnetic field at the distal end of the filament, is adopted. Therefore, since space can be reduced compared with other ion sources, this is advantageous for miniaturization of the cyclotron.

In the cyclotron according to the embodiment of the present invention, the filament may be formed by bending a metal plate.

According to this configuration, since the width direction of the metal plate is matched with a direction in which the Lorentz force is applied, it is possible to simplify the configuration of the filament while ensuring the strength against the Lorentz force. This is advantageous in reducing the manufacturing cost of the filament.

Hereinafter, a preferred embodiment of the present invention will be described with reference to the drawings.

As shown in FIG. 1, a cyclotron 1 according to the present embodiment is a circular accelerator that accelerates ions supplied from an ion source 2 using a magnetic field and outputs a charged particle beam. As ions supplied from the ion source 2, for example, protons, heavy particles (heavy ions), electrons, and the like can be mentioned. For example, the cyclotron 1 is used as an accelerator for charged particle beam therapy.

The ion source 2 is located at the center of the disc-shaped cyclotron 1, and is supported by a columnar support member 3 extending along the central axis C of the cyclotron 1.

The cyclotron 1 includes an annular coil 4 disposed around the central axis C, an RF cavity 5 disposed in the air core portion of the coil 4, a hollow yoke 7, and a control unit 8. The yoke 7 is a disc-shaped hollow block formed of magnetic metal, and the coil 4 and the RF cavity 5 are disposed inside the yoke 7.

The control unit 8 is an electronic control unit configured to include a central processing unit (CPU), a read only memory (ROM), a random access memory (RAM), and the like. The control unit 8 performs overall control of the cyclotron 1.

The cyclotron 1 accelerates ions supplied from the ion source 2 in space G within the RF cavity 5 by supplying a current to the coil 4 to generate a strong magnetic field (arrow B), and outputs an ion beam. The strong magnetic field is a magnetic field of 1 T [tesla] or more, for example. Inside the cyclotron 1, for example, a magnetic field of approximately 1 T to 3 T is formed.

Figure 2:
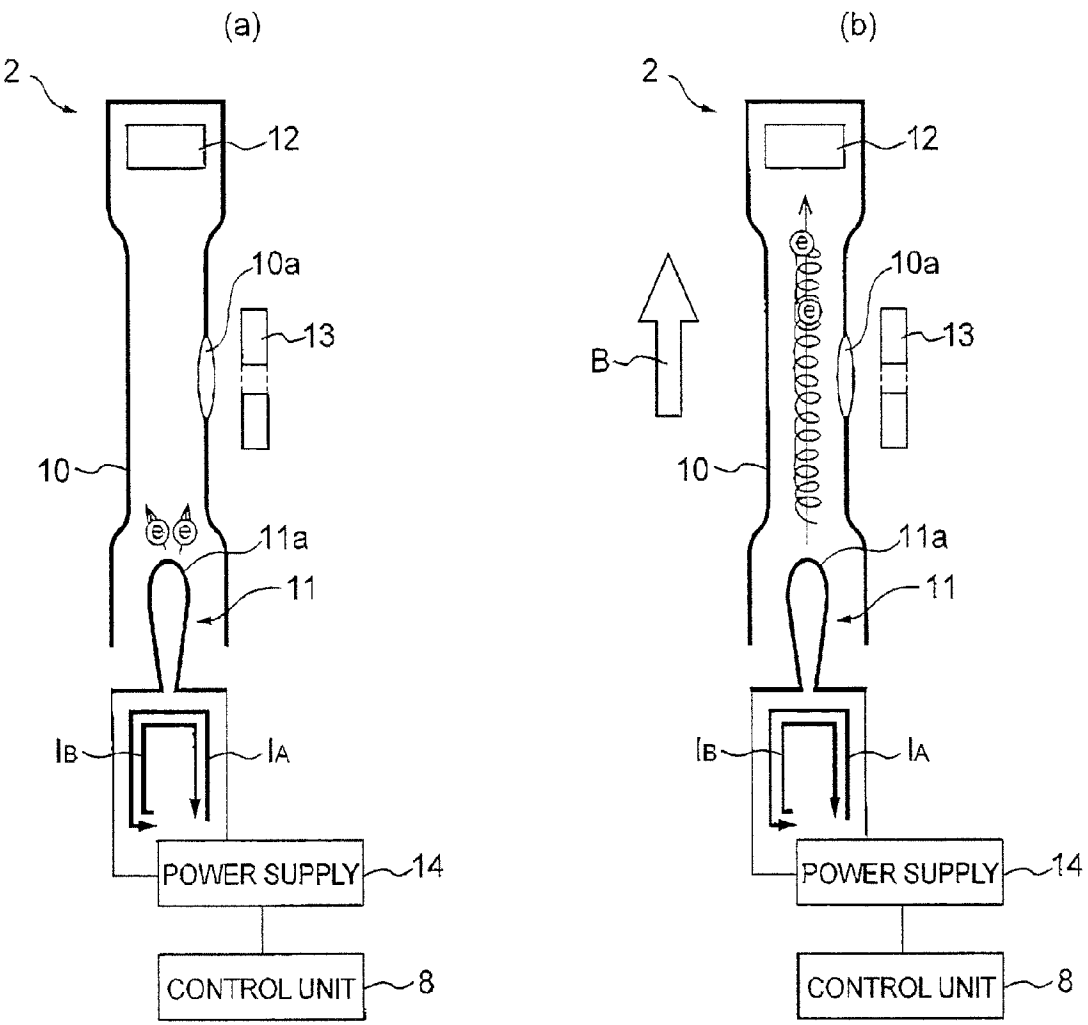
FIG. 2A is a diagram for explaining the generation of electrons in the ion source.
FIG. 2B is a diagram for explaining the motion of electrons in the ion source.
Figure 3:
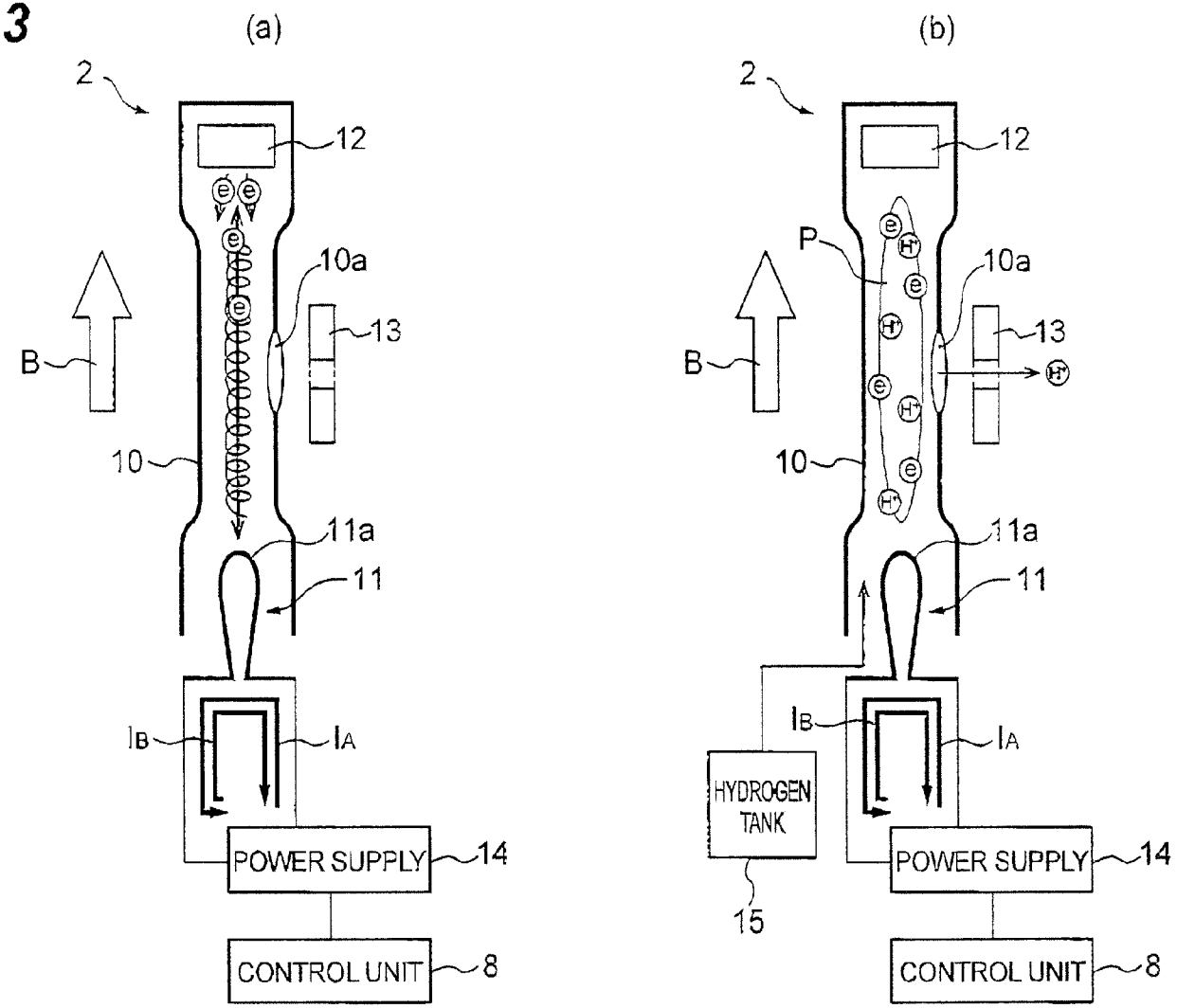
FIG. 3A is a diagram for explaining the collision of electrons in the ion source.
FIG. 3B is a diagram for explaining the generation of hydrogen ions in the ion source.

FIGS. 2A, 2B, 3A, and 3B are diagrams for explaining the ion source 2. First, the configuration of the ion source 2 will be described with reference to FIG. 2A. As shown in FIG. 2A, the ion source 2 includes a conductive chimney (cylindrical body) 10, a filament 11 and an anti-cathode 12 disposed in the chimney 10, and an extraction electrode 13 for extracting ions from the chimney 10.

The chimney 10 is a conductive cylindrical member having a closed upper end. The anti-cathode 12 is disposed on the upper end side in the chimney 10. A lower end side of the chimney 10 is open, and the filament 11 is disposed by being inserted from the lower end side.

A slit 10*a* for extracting hydrogen ions (protons) $H^+$ is formed on the side surface of the chimney 10. Hydrogen ions $H^+$ extracted from the slit 10*a* accelerate while traveling along the orbit rotating around the chimney 10. In the chimney 10, a middle portion in which the slit 10*a* is located is formed in a narrow shape according to the rotation orbit of hydrogen ions $H^+$. In addition, the shape of the chimney 10 is not limited to that described above.

The filament 11 is a member for emitting electrons (hot electrons) e into the chimney 10 by generating heat by the flow of a current. For example, the filament 11 is a metal plate formed of Ta (tantalum), and is formed by bending a single metal plate.

Specifically, the filament 11 is formed by bending a single metal plate in the shape of Ω that is open downward. A curved portion at the distal end of the filament 11 is called a curved portion 11*a*. In addition, the shape of the filament 11 is not limited to that described above. For example, the filament 11 may be formed by bending a single metal plate in the shape of U that is open downward.

The anti-cathode 12 is an electrode for holding an electron e in the chimney 10. The anti-cathode 12 is disposed so as to face the filament 11 in a magnetic field direction in the chimney 10, and is fixed to the chimney 10 through an annular insulator (not shown). The anti-cathode 12 holds the electron e in the chimney 10 by making the electron e reciprocate in the magnetic field direction between the anti-cathode 12 and the filament 11.

The extraction electrode 13 is an electrode for extracting the hydrogen ions $H^+$ generated in the chimney 10 from the slit 10*a*. The extraction electrode 13 is provided outside the slit 10*a*, and extracts the hydrogen ions $H^+$ when an extraction voltage is applied between the extraction electrode 13 and the chimney 10.

In addition, a power supply 19 for supplying a current to the filament 11 is connected to the ion source 2. The power supply 14 is a DC power supply, and supplies a DC current to the filament 11.

The power supply 14 is controlled by the control unit 8, and changes the direction of the current to the filament 11 in response to a signal from the control unit 8. That is, the power supply 19 is configured to be able to change the direction (arrow $I_A$ or arrow $I_B$) of the DC current to the filament 11. The power supply 14 is disposed outside the yoke 7. In addition, a dedicated power supply is provided in the chimney 10.

In addition, a hydrogen tank 15 for introducing hydrogen gas into the chimney 10 is provided outside the ion source 2 (refer to FIG. 3B). The hydrogen tank 15 is disposed outside the yoke 7, and hydrogen gas is introduced into the chimney 10 through the inside of the support member 3.

Next, the generation of ions in the ion source 2 will be described. FIG. 2A is a diagram for explaining the generation of the electron e in the ion source 2. As shown in FIG. 2A, in the ion source 2, first, the control unit 8 controls the power supply 14 to supply a current to the filament 11. The filament 11 generates heat due to the supply of a current, and emits the electron e (hot electron) from the curved portion 11*a* or the like.

FIG. 2B is a diagram for explaining the motion of the electron e in the ion source 2. The control unit 8 controls a power supply for the chimney 10 to apply a voltage (arc voltage) between the chimney 10 and the filament 11. Accordingly, the electron e emitted from the filament 11 can be extracted to the chimney 10. However, since a strong magnetic field generated by the coil 4 is present inside and outside the ion source 2, the electron e is trapped in the magnetic field and moves while accelerating in the magnetic field direction (direction of arrow B).

FIG. 3A is a diagram for explaining the collision of the electron e in the ion source 2. As shown in FIG. 3A, in the ion source 2, a new electron e is generated from the anti-cathode 12 due to the electron e moving in the direction of arrow B and colliding with the anti-cathode 12. The electron e generated from the anti-cathode 12 moves while accelerating in a direction opposite the arrow B along the magnetic field direction. In this manner, the electron e reciprocates between the filament 11 and the anti-cathode 12.

FIG. 3B is a diagram for explaining the generation of hydrogen ions in the ion source. As shown in FIG. 3B, in the ion source 2, hydrogen gas is introduced from the hydrogen tank 15 into the chimney 10 in a state where the electron e reciprocates within the chimney 10. The control unit 8 also controls the introduction of hydrogen gas. Thus, in the chimney 10, hydrogen ions $H^+$ are generated by collision of the electron e and the hydrogen molecules $H_2$, and plasma P in which the hydrogen ions $H^+$ and the electron e are mixed is generated.

The extraction electrode 13 extracts the hydrogen ions $H^+$ from the plasma P in the chimney 10 when the extraction voltage is applied thereto. The hydrogen ions $H^+$ are extracted through the slit 10*a*, and accelerate while rotating around the chimney 10. The cyclotron 1 forms an ion beam by extracting the hydrogen ions $H^+$ continuously from the chimney 10 using the extraction electrode 13 and accelerating the hydrogen ions $H^+$ using a magnetic field and an electric field.

Figure 4:
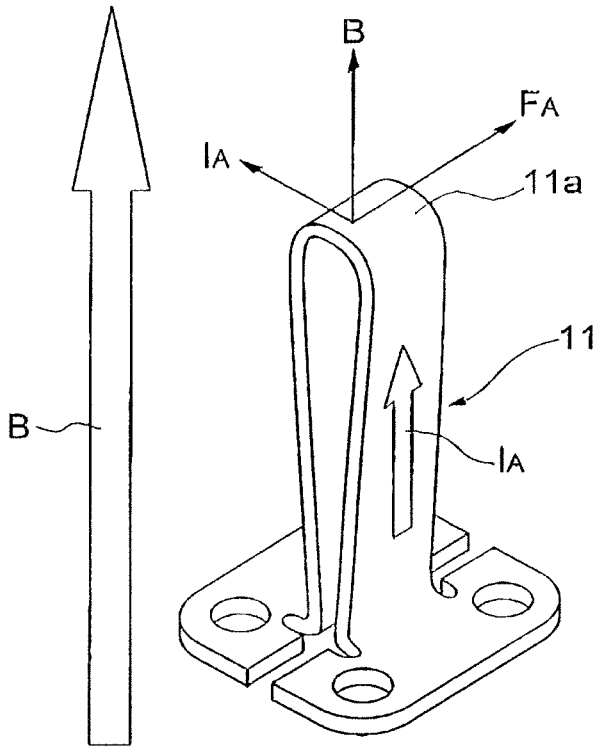
FIG. 4 is a perspective view for explaining the Lorentz force $F_A$ applied to a filament when a current flows in a direction of arrow $I_A$.

Here, FIG. 4 is a perspective view for explaining the Lorentz force $F_A$ applied to the filament 11 when a current flows in a direction of arrow $I_A$. As shown in FIGS. 2A to 4, when a current flows in the direction of arrow $I_A$ with respect to the filament 11, the Lorentz force $F_A$ is applied to the curved portion 11*a* of the filament 11 due to the influence of a strong magnetic field (for example, a magnetic field of 1 T or more). Since the Lorentz force $F_A$ is applied to the filament 11 as long as a current flows, deformation occurs gradually in the filament 11.

Figure 5:
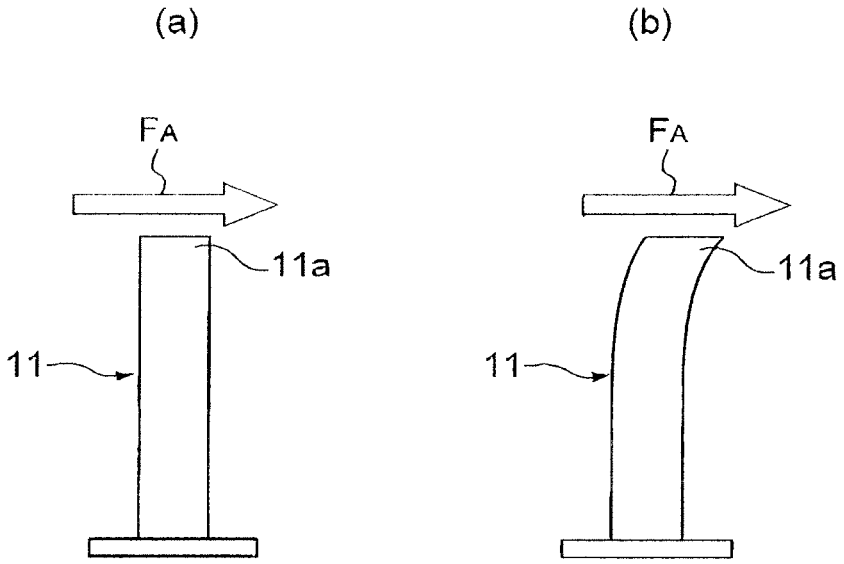
FIG. 5A is a side view showing a filament before deformation.
FIG. 5B is a side view showing a filament after deformation.

FIG. 5A is a side view showing a filament before deformation, and FIG. 5B is a side view showing a filament after deformation. As shown in FIGS. 5A and 5B, as operating time increases, the filament 11 is deformed in a direction in which the curved portion 11*a* at the distal end falls down due to the influence of the Lorentz force E. For this reason, it is necessary to replace the filament 11 every predetermined period.

Figure 6:
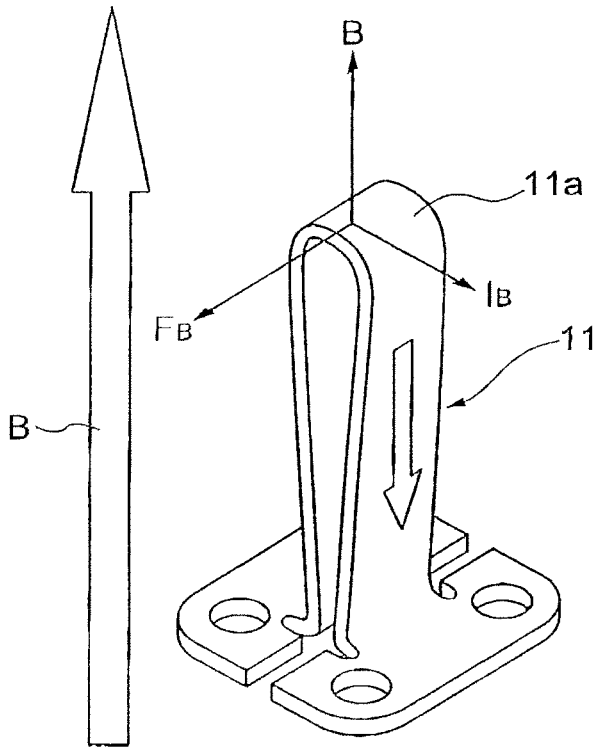
FIG. 6 is a perspective view for explaining the Lorentz force $F_B$ applied to a filament when a current flows in a direction of arrow $I_B$.

Therefore, the control unit 8 changes the direction of the current in the filament 11 in order to suppress the deformation. FIG. 6 is a perspective view for explaining the Lorentz force $F_B$ applied to the filament 11 when a current flows in a direction of arrow $I_B$. As shown in FIG. 6, the Lorentz force $F_A$ applied to the filament 11 is switched to the Lorentz force $F_B$ in the opposite direction by changing the direction of the current from arrow $I_A$, to arrow $I_B$ by performing polarity switching of the power supply 14 with respect to the filament 11. Then, since the direction of the force applied to the filament 11 is changed, it is possible to suppress the deformation of the filament 11 in one direction.

The control unit 8 changes the direction of the current to the filament 11 every predetermined time. The control unit 8 may change the time interval to change the direction of the current according to the operating conditions of the cyclotron 1 or the like. Conditions under which the control unit 8 changes the direction of the current are not limited to those described above. For example, the control unit 8 may change the direction of the current on the basis of the detection state of ions extracted from the chimney 10.

In the cyclotron 1 according to the present embodiment described above, even if the Lorentz force is applied to the filament 11 due to the influence of a strong magnetic field, the direction of the Lorentz force is changed by changing the direction of the current supplied to the filament 11. Accordingly, compared with a case where the Lorentz force is continuously applied in a fixed direction, it is possible to suppress the deformation of the filament 11 and increase the lifespan of the filament 11. As a result, since it is possible to reduce the frequency of replacement of the filament 11, it is possible to significantly reduce the maintenance cost and maintenance effort for the cyclotron 1.

In addition, in the cyclotron 1, the DC power supply 14 is adopted, and the direction of the DC current is changed by the control unit 8. Therefore, compared with a case where the direction of the current is constantly changed using an AC current, it is possible to perform effective current control considering the state of the filament 11.

In addition, in the cyclotron 1, a so-called hot cathode PIG ion source, in which a current flows in a direction perpendicular to the magnetic field on the distal end side of the filament 11, is adopted. Therefore, since space can be reduced compared with other ion sources, this is advantageous for miniaturization of the cyclotron. In addition, since the hot cathode PIG ion source can be stably operated even in a small space, it is possible to increase the reliability of the cyclotron 1.

In addition, in the cyclotron 1, the filament 11 is formed by bending one metal plate, and the width direction of the metal plate is made to match a direction in which the Lorentz force is applied. Therefore, it is possible to simplify the configuration of the filament 11 while ensuring the strength against the Lorentz force. This is advantageous in reducing the manufacturing cost of the filament 11.

The present invention is not limited to the embodiment described above. For example, the power supply does not need to be a DC power supply, and may be an AC power supply. Since the direction of the current is changed if AC current is used, the direction of the Lorentz force applied to the filament is changed. Accordingly, it is possible to increase the lifespan of the filament.

In addition, the configuration of the ion source is not limited to that described above. The shape of the chimney or the filament is not limited to those described above. The chimney may have a square tube shape instead of the cylindrical shape, and a narrow portion does not necessarily need to be provided in the middle. In addition, the filament may be bent in an angular shape.

EXAMPLES

Hereinafter, a current direction change (polarity switching) in the cyclotron according to the embodiment of the present invention will be described by way of examples and comparative examples.

In an example, Ta (tantalum) was adopted as a material of a filament, and a filament with the shape shown in FIG. 4, which had a height of 25 mm, a width of 5 mm, and a thickness of 0.5 mm, was used. A DC current supplied to the filament was set to 200 A [ampere], and the magnetic field was set to 1.75 T [tesla]. An arc voltage applied between the filament and the chimney was set to 185 V [volt].

A test was performed for four hours while changing the direction of the current supplied to the filament every hour in a state in which the cyclotron was operating. Then, the amount of bending (displacement of the apex of the filament) of the filament was measured.

In a comparative example, for the same filament as in the example, a test was performed for four hours without changing the direction of the current, and the amount of bending was measured.

Figure 7:
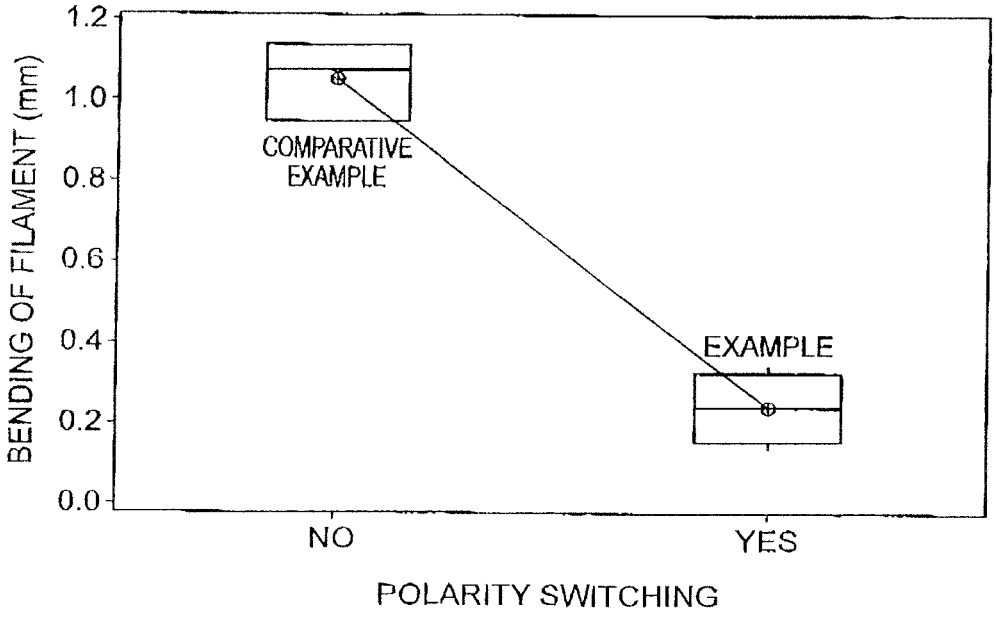
FIG. 7 is a box plot showing a change in the amount of bending of a filament due to polarity switching.

FIG. 7 is a box plot showing a change in the amount of bending of the filament due to polarity switching. As shown in FIG. 7, in the example in which there was polarity switching (current direction change), the amount of bending of the filament was about 0.2 mm. On the other hand, in the comparative example in which there was no polarity switching (current direction change), the amount of bending of the filament was about 1 mm. The amount of bending in the example was about ⅕ of that in the comparative example.

It should be understood that the invention is not limited to the above-described embodiment, but may be modified into various forms on the basis of the spirit of the invention. Additionally, the modifications are included in the scope of the invention.

What is claimed is:

1. A cyclotron that accelerates an ion using a magnetic field, comprising:

a hollow yoke; and an ion source that is provided in the yoke and generates an ion, wherein the ion source includes a conductive cylindrical body and a filament disposed in the cylindrical body, wherein a current is supplied from a power supply to the filament, and a direction of the current supplied to the filament is changed, wherein the cyclotron further comprises a control unit that changes a direction of the current, wherein the current is a DC current, wherein a current flows in a direction perpendicular to a magnetic field at a distal end of the filament, and wherein the filament is formed by bending a metal plate.

* * * * *